US007178814B2

(12) United States Patent
Mash

(10) Patent No.: US 7,178,814 B2
(45) Date of Patent: Feb. 20, 2007

(54) SPORT BOARD

(76) Inventor: Paul T. Mash, P.O. Box, Mt. Clemens, MI (US) 48046-0294

( * ) Notice: Subject to any disclaimer, the term of this patent is extended or adjusted under 35 U.S.C. 154(b) by 9 days.

(21) Appl. No.: 10/988,035

(22) Filed: Nov. 13, 2004

(65) Prior Publication Data

US 2005/0206109 A1 Sep. 22, 2005

Related U.S. Application Data

(63) Continuation-in-part of application No. 10/310,170, filed on Dec. 4, 2002, now Pat. No. 6,834,881.

(60) Provisional application No. 60/338,772, filed on Dec. 4, 2001.

(51) Int. Cl.
*B62M 1/00* (2006.01)

(52) U.S. Cl. ..... 280/87.042

(58) Field of Classification Search ..... 280/87.01, 280/87.021, 87.041, 87.042, 842, 14.21, 280/14.22; 441/68, 70
See application file for complete search history.

(56) References Cited

U.S. PATENT DOCUMENTS 4,120,510 A * 10/1978 Hillard ..... 280/87.042
4,182,520 A * 1/1980 Stevenson ..... 280/87.042
4,848,781 A * 7/1989 Dykema et al. ..... 280/14.21
5,127,672 A * 7/1992 Horibata ..... 280/842
5,839,737 A * 11/1998 Kruczek ..... 280/11.115
6,158,752 A * 12/2000 Kay ..... 280/87.042
6,199,881 B1 * 3/2001 Wood et al. ..... 280/87.042
6,789,806 B2 * 9/2004 Santa Cruz et al. ..... 280/14.21
2004/0195795 A1 * 10/2004 Huang ..... 280/87.042
2005/0269794 A1 * 12/2005 Lukes ..... 280/87.042

FOREIGN PATENT DOCUMENTS

DE 3 712 807 A1 * 11/1988

* cited by examiner

*Primary Examiner*—Frank Vanaman
(74) *Attorney, Agent, or Firm*—The Weintraub Group, PLC

(57) ABSTRACT

A sport board and a shock absorption system therefor, includes a glide board used in snow and aquatic sports or a roller or skate board, a rocker platform mounted in a seesaw fashion atop the sport board, whereupon opposite ends of the rocker platform may alternately move towards and away from the sport board, and a shock absorbing cushion disposed in respective spaces formed between the forward end portions and the rearward end portions of the sport board and platform. The cushions inhibit rocking of the rocker platform, absorb impact, and create a cushion sufficient for the rider to exert extreme pressures for balance, control, and maneuvers on any given terrain conditions. As a skate board, the board is curvilinear, including a center section that is spring-like and downwardly concave opposed end sections that are upwardly concave, and roller assemblies are proximate the opposite ends or end sections. The board includes shock absorbing bumpers.

20 Claims, 5 Drawing Sheets

FIG 3
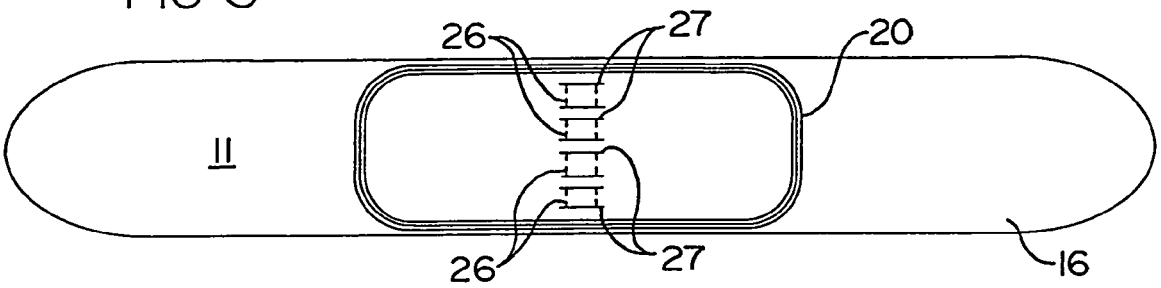
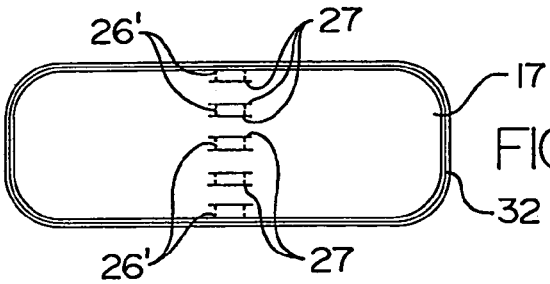
FIG 4
FIG 5
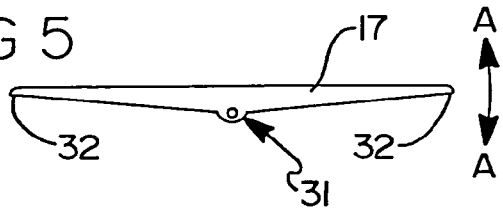
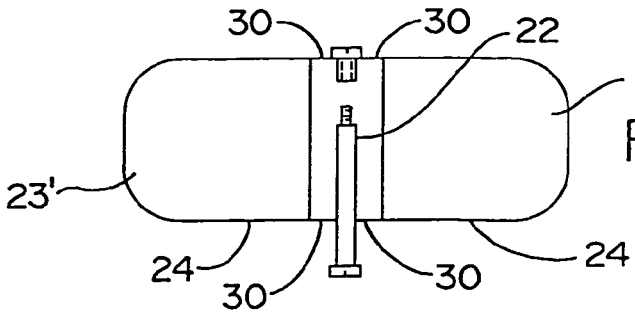
FIG 6

FIG 7
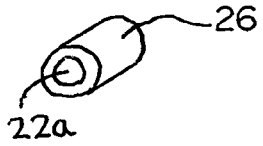
FIG 8
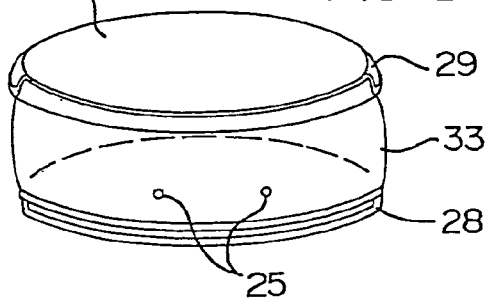
FIG 9
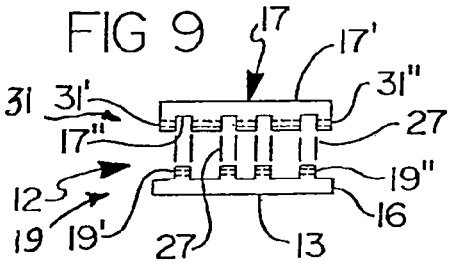
FIG 9A
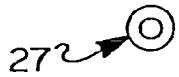
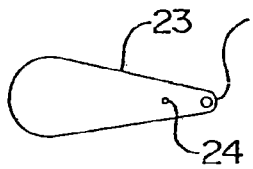
FIG 10
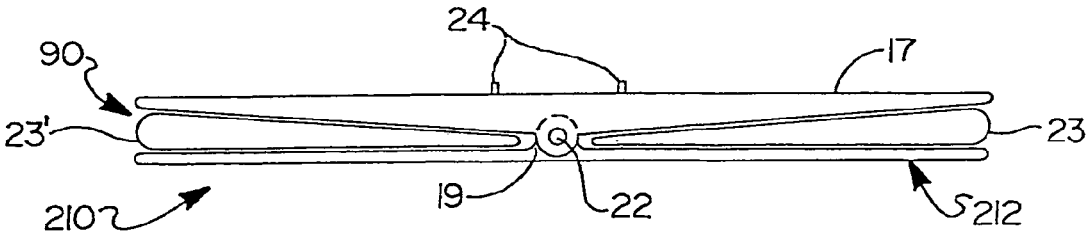
FIG 11

SPORT BOARD

CROSS-REFERENCE TO RELATED APPLICATIONS

This is a continuation-in-part Patent Application of co-pending U.S. patent application Ser. No. 10/310,170 filed Dec. 4, 2002, which issued Dec. 28, 2004 as U.S. Pat. No. 6,834,881 B2, and is a Completion Application of co-pending of U.S. Provisional Patent Application Ser. No. 60/338,772, filed Dec. 4, 2001, the entire disclosures of each incorporated herein by reference.

BACKGROUND OF THE INVENTION

1. Field of the Invention

The present invention pertains to an improved design for a sport board, such as exemplified by a skate board, kite board, snow board, snow skate board, ski board, sail board, wave board, snow skis, and like sports and leisure related boards. More particularly, the present invention concerns a shock absorbing system for a gliding type sport board and roller type skate board.

2. Prior Art

In recent years, board-related sport including land sports such as snowboarding, skate boarding, and water or aquatic sports have continued to become increasingly popular sports. These sports have also become more competitive and demanding on both the rider and the equipment. The demand continues in these recreational and competitive land and water sports.

In any form of transportation, there is an inherent element of "shock" that is produced by changing terrain conditions that transfers energy from the terrain ground or water into the vehicle that is speeding across it. In most forms of transportation, the vehicle has been equipped with some form of "shock absorbers" to smooth out the ride and to increase performance of both the equipment and the rider. It has become essential for the vehicle to be equipped with shock absorbers especially in vehicles like snowboards, skateboards, water skis and wakeboards. The present invention, as subsequently detailed, addresses this issue.

SUMMARY OF THE INVENTION

In accordance herewith, there is provided a shock absorbing system for a gliding or sport board which comprises:

a lower sport or sporting board, an upper rocker platform, and a rocker system associated said platform with said sporting board.

The rocker system or rocker, generally, comprises a pair of spaced apart first and second or lower and upper, respectively, rocking members which are disposed transverse to the longitudinal axis of the sport board. The rocking members are hingedly interconnected through suitable means to enable the rocker to rotate or pivot forward and aft.

The first or lower rocking member is integral with or otherwise affixed to the board on the upper surface thereof.

The upper or second rocking member is affixed to the upper rocker platform which is disposed above the lower sport board such that a space is created between the bottom of the rocker platform and the upper surface of the lower sport board.

The upper rocking member and the lower rocking member include interdigitating, aperatured flanges, cylinders, spacers or hinge members and the like which cooperate to define a hinge. A hinge pin, or the like, extends through the aperature of the hinge and interconnects the two two together and defines a pivot or fulcrum about which the rocker platform rotates. The hinge connection forms a seesaw or teeter totter like structure in which the opposite free ends of the rocker platform alternately pivot up and down towards and away from the upper surface of the dual binding sport board.

In a first embodiment here, a pair of bladders or other compressible bodies are affixed to the upper surface of the board, one on each side of the hinge, in the space between the board and the platform. Thus, as the platform teeters or pivots between a forward and an aft position on the board, it will encounter one of the two bladders. Each bladder is inflatable and contains the same amount of fluid, such as air.

The bladders and hinge may be encased within a sealed shroud or the like to protect it from the elements.

It is further contemplated in the practice of the present invention that the present invention be part of an original equipment or that it be retrofitted wherein the bladders, rocker members, and platform are disposed on a mounting plate which is secured to a sports board.

According to an important aspect of this invention there is provided a dual binding sport board, characterized by a roller or skate board, said dual-binding sport board comprising:

a lower platform having a center section, a forward end section, and a rearward end section, a first and a second roller assembly for rollably supporting the platform on the ground, said assemblies secured, respectively, to the forward and rearward end sections of said platform, a rocker platform having a center section, a forward end section, and a rearward end section, a hinge for hingedly connecting the center sections together, wherein the forward and rearward end sections alternately move towards and away from one another, and wherein a first and second space is defined between the platforms and on opposite sides of the hinge connection, and a first and a second compressible member disposed, respectively, in said first space and said second space, said compressible members resisting movement of the end sections towards one another.

In the above-noted dual-binding sport board, the upper rocker platform associated with the skateboard or roller board may be provided with binding structure for securing the feet of the rider atop the rocker platform. Typically, two separate foot bindings are provided, one and the other located on opposite sides of the fulcrum, one binding for the left foot and the other binding for the right foot.

The platforms are generally oblong, have a central longitudinal axis, parallel lateral sides extending longitudinally, and top and bottom surfaces. When hingedly connected, the forward and rearward end sections and lateral sides are generally in juxtaposed relation with one another.

In a skate board, as in the first described gliding board, the compressible member may be an air bladder, a compressible body of foam, or compressible body of a suitable elastomeric material, such as rubber. The compressible member may be affixed to the upper surface of the lower platform. Thus, as the rocker platform teeters or pivots between a forward and an aft position above the lower platform or board, the forward or rearward end section thereof, depending on the direction of rotation, will move toward and encounter one of the two compressible members, which member will elastically compress and absorb shock.

According to an important feature of the present invention, the lower platform forms a compound curve wherein the center section is concave down, so as to form a resilient bow-like or spring structure between the roller assemblies that absorbs and distributes vertical landing loads, and the front and rear end sections are concave up. The upper platform is generally planar and the front and rear end sections are concave up.

Additionally, according to another important feature, shock absorbing bumpers are provided on the curled up forward and rearward ends of the rocker platform.

In all other respects, such as the hinged connection, bladder securement, retrofitting, interconnection, and the like are the same as that described for the gliding sport board.

For a more complete understanding of the present invention, references made to the following detailed description and accompanying drawings. In the drawings, like reference characters refer to like parts throughout the several views in which:

BRIEF DESCRIPTION OF THE DRAWINGS

FIG. 3 is a top view of a sports board having the lower rocker member mounted thereto;

FIG. 4 is a bottom review of the platform used herein having the upper rocker member mounted thereonto;

FIG. 5 is a partial side view showing the platform and the hinge pinhole;

FIG. 6 is a plan view, partly exploded, showing the hinge pin and the air bladders used herein;

FIG. 7 is a perspective view of a hollow cylindrical sleeve;

FIG. 8 depicts the rubber outer containment housing or shroud with upper and lower rubber seals and valve ports;

FIG. 9 is a front view of the upper and lower rocker members;

FIG. 9A is a front view of a toroidal spacer;

FIG. 10 is a side view of an air bladder;

FIG. 11 is a side view of a second embodiment hereof;

DETAILED DESCRIPTION OF THE PREFERRED EMBODIMENT

Figure 1:
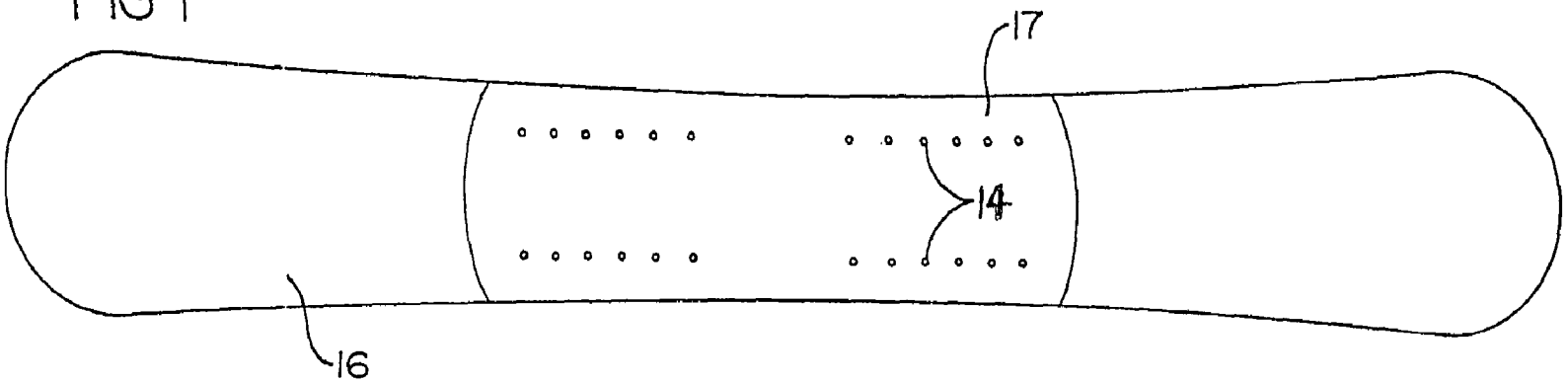
FIG. 1 is a top view of a sports board for use in the present invention.

According to the present invention, and with reference to the drawings, there are depicted leisure related gliding and roller boards used in various ground and aquatic sports, the boards being provided with a shock absorbing system. Depending on the sport, these boards are called a ski board, skate board, wake board, water board, water ski(s), kite board, snow board, sail board, wave board, snow ski(s), and ski, and comprise a category of sporting equipment having a platform upon which a rider stands or kneels with both feet, the platform having a strong, resilient, flexible and substantially flat structure conventionally made of one or materials including wood, plastic and fiber glass or carbon fiber. The present invention is contemplated for use in connection with and conjointly with any one of such dual footing boards.

In FIGS. 1–10, a first embodiment according to this invention comprises a gliding type sports board, generally denoted at 16. The board 16 is referred to as a snowboard and is for illustrative purposes only. That is, the present invention is applicable to any other type of board such as those alluded to hereinabove.

The board or sports board 16 hereof has an upper surface 11 and a lower surface 13. Disposed on the board 16 is a shock absorbing system or shock absorber defined by a rocker system or rocker, generally, denoted at 12 (FIG. 9).

The rocker system hereof, generally, comprises:

a first or lower rocker member 19 which is disposed atop the board 16, and an upper or second rocker member 31 which interdigitates with and is hingedly connected to the lower rocker member via means for hingedly interconnecting such as a pin or hinge pin 22.

In a first embodiment hereof, the lower rocker member or fulcrum 19 is secured to the upper surface 11 of the board 16 by any suitable means and, preferably, is molded integrally with the board. The lower rocker member 19, generally, comprises an elongated body disposed on the upper surface 11 of the sports board 16 that extends across the width thereof. The lower rocker member 19 further includes:

a pair of spaced apart flanges 19', 19", each having an aperture 22*a* formed therein for receiving and passing the hinge pin 22, and a plurality of hollow cylindrical sleeves 26 which are mounted onto the transverse rocker member or fulcrum 19 or is integrally formed therewith.

The sleeves 26, as noted, are cylindrical and have a hollow interior or passage 22*a* for passing hinge pin 22. The aperatures of the sleeves 26 are co-axil with themselves and the aperatures of the flanges 19' and 19". A plurality of toroidal or donut-shaped spacers 27, as shown in FIG. 9A, each having a central aperature 22*a*, may be provided to reduce wear, one spacer being disposed on either side of associated sleeves 26, as shown in FIG. 9.

Disposed on either side of the fulcrum are compressible members 23 and 23'. Each compressible member is similar. The compressible members 23 and 23' can comprise any suitable article such as a section of compressible foam, an inflatable bladder, or the like. Each of the bladders is independently inflatable with a suitable fluid such as water, air or the like. A valve member 24 associated with each bladder may be used to inflate and deflate its associated bladder, as desired. Preferably, in the practice of the present invention, each of the bladders contains the same amount of fluid so that they are substantially equal. Preferably, the bladders are air bladders. Optimally, the bladders or compressible members are toroidal (i.e., donut shaped and having a central hole or opening) although other shapes can be used. The toroidal shape is not shown as the term would be understood by those in the art.

The compressible members are secured to the upper surface of the board by any suitable means such as through an anchor 30. Alternatively, the bladders may be secured to the upper surface 11 with a nylon hook and fastener (Velcro), gluing, or the like. Alternatively, air pressure, alone, within the compressible members may be used to retain the compressible members to the upper surface of the board by sandwiching the members between the board and the platform.

As shown, a first sealing element or rim seal 20 is circumferentially disposed about the lower rocker member 19. The rim seal 20 is used to attach a lower portion of a shroud 33 to encase the lower rocker 19 and to protect it from the elements, as explained herein below. The rim seal 20 secures a lower seal 28 associated with the shroud 33 thereto. Sealing is accomplished by snap-fitting the lower seal 28 into the lower rim seal 20.

Figure 2:
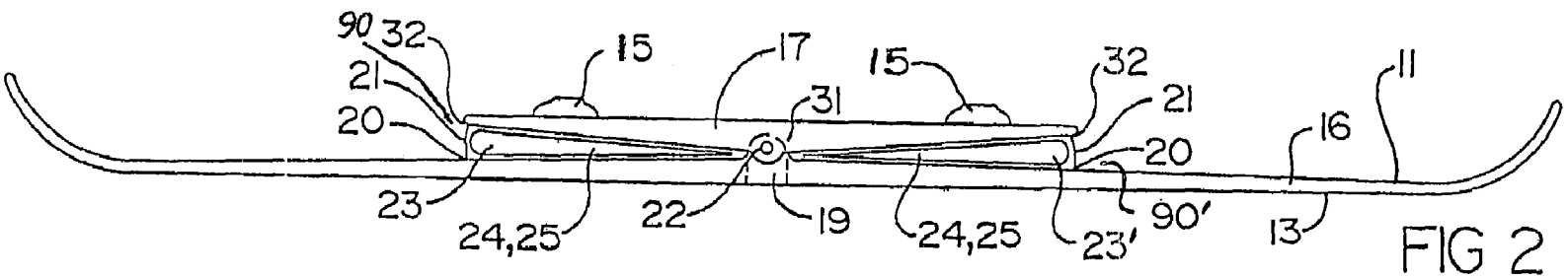
FIG. 2 is a side view of a sports board having the rocker system hereof mounted thereto.

As noted, the upper rocker member 31 is constructed similar to the lower rocker member 19 and includes apertured flanges 31' and 31". The upper rocker member 31 is secured to a rocker platform 17. The rocker platform 17 has an upper surface 17' and a lower surface 17". As shown, the upper rocker member 31 is integral with or otherwise affixed to the lower surface 17". As shown in FIG. 5, the lower surface 17" of the rocker platform 17 is substantially bisected by the transverse rocker or fulcrum member 31 into a pair of identical sections. As shown in FIGS. 2 and 5, the bottom surface 17" of the rocker platform 17 tapers longitudinally forward and rearward from the fulcrum member 31 to the opposite longitudinal ends of the platform 17. The bottom surface of the rocker platform forms with the upper surface 11 of the lower board 16 a pair of opposed closable spaces 90 and 90' sized to receive a compressible member 23 and 23'. The taper of the bottom or lower surface 17" of the platform permits the space 90 and 90' between the lower surface of the platform 17 and the upper surface 11 of the board 16 to reduce quickly when the platform and the board teeter into each other.

The upper rocker member 31 also includes a plurality of co-axial hollow cylindrical sleeves 26'. The sleeves 26' are constructed similarly to the sleeves 26 disposed on the lower rocker member 19 and each includes a central passage 22*a* for passing the hinge pin 22. Further, the sleeves 26 and 26' are spaced in a manner such that the sleeves 26' will interdigitate, with the sleeves 26, as shown in FIG. 9. The sleeves 26' may be integrally formed with the fulcrum member 31 or may comprise a plurality of sleeves mounted thereonto. It should be noted in this regard, that the sleeves formed in the transverse upper fulcrum member 31 may be integrally molded therewith, as shown in FIG. 9. Since the aperatures 22*a* in each of the sleeves 26 and 26' are coaxial, the hinge pin 22 can project therethrough to hingedly interconnect the upper rocker member 31 of the platform to the lower rocker member 19 and mount the platform 17 in seesaw fashion atop the board 16.

It is readily appreciated that the platform pivots about the pin 22 both fore and aft in the directions of the arrow A (FIG. 5).

It should be noted that the intermediate sleeves 26 and 26' are optional since it is only necessary that the apertures 22*a* of the flanges 19' and 19" and 31' and 31" of the lower and upper rocker members 19 and 31 alien with one another so that the hinge pin 22 may project therethrough and hingedly interconnect the upper rocker to the lower rocker. Thus, only the apertured flanges 19' and 19", and 31' and 31" are necessary for hinged interconnection. Optionally, a plurality of toroidal wear rings or spacers 27 may be disposed between the sleeves 26 and 26' to prevent wear or the like. In this regard, because the sleeves 26 and 26' are dimensioned to form interdigitating hinge members, the spacer sleeve 27 is disposed between adjacent of the hinge sleeves 26 and 26' to prevent wear therebetween arising from the up-and-down pivoting of the platform 17 relative to the platform 16.

Figure 14:
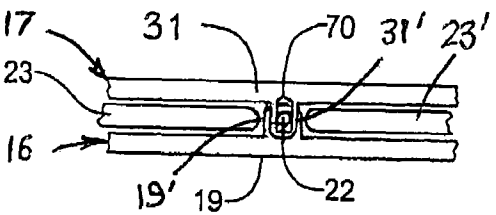
FIG. 14 is a broken elevational view of an alternate hinge assembly.

Alternatively, and as shown in FIG. 14, the apertures in one or both respective pairs of flange members 19' and 19", and 31' and 31" may be elliptical (e. g., oval or race-track) in shape having a height greater than the width thereby creating a vertical slot 70. This vertical slot 70 enables the hinge pin to be vertically axially moveable in the slot and the rocker platform 17 to thus move up and down towards and away from the sport board 16 to further cushion the ride.

Additionally, in addition to providing a teeter-totter like rocker connection between the rocker platform 17 and sport board 16, wherein the fore and aft sections of the platform alternately pivot towards and away from the upper surface of the board 16, the axial slot 70 provides further cushioning movement of the platform. The vertical axial slots 70 enables the axis of the hinge pin 22 (and thus the platform 17) to move vertically up and down in generally parallel relation to the upper surface 11 of the board 16. Further, the laterally opposed slots enable the axis of the hinge pin (and thus the plane of the platform) to tilt and be at an acute angle with the upper surface 11. That is, one end of the hinge pin 22 in the apertured flanges 19' and 31' on one lateral side of the platform 17 may be vertically higher (or lower) above the board 16 than the other end of the hinge pin in the apertured flanges 19" and 31" on the other lateral side of the platform. These three positions (i.e., pivoting, up/down parallel movement, and tilting) of the platform 17 relative to the board 16 may be substantially simultaneous to provide cushioning control upon hard landings.

As shown in FIGS. 5 and 8, secured to the lower surface of the platform and surrounding the upper rocker member is a rim seal 32. The rim seal 32 slidingly fits into the lower rim seal 28 to effectively close off the rocker system from the elements. The shroud 33 carries the seals 28 and 29.

In order to maintain the rocker system sealed off from the elements and to maintain the integrity and pressure within the bladders, valve ports 25 are provided in the seal or shroud 33. The valves 24 extend from each of the bladders and protrude through the ports 25 to enable them to be connected to a suitable source of compressed air or other fluid (not shown). A pressure gauge or the like (not shown) can be operatively affixed to the valves to measure and control the pressures within the bladders.

When the outer containment housing or shroud 33 is placed around the rocker assembly, the upper seal 29 and the lower seal 28 are snapped into the upper rim seal 32 and the lower rim seal 20, respectively, to form a seal that will protect all the components inside from water, snow, ice, etc. The outer containment housing is a continuous piece made of rubber or other suitable material. The outer containment housing includes a bead that snaps into the rim seals all the way around the shock absorbing assembly to protect it from the elements. The shroud 33, being attached at both its top and bottom, has a sufficient extension capability to allow full range of motion of the most forward part and most aft part of the platform.

It should be noted that the shroud is not essential to the practice of the present invention. When not present, the valves extend, preferably, from the compressible members and project therefrom to a suitable accessible place, such as through the platform, as shown and discussed with reference to FIG. 11 hereinbelow.

With the board and the platform joined together, there is defined a unitary shock absorbing assembly. The board and the platform are free moving parts, able to teeter in opposite directions from one another.

The user, when deploying the present invention as a snowboard is positioned on the platform, toes pointing to one lateral edge, and heels pointing to the other or opposite lateral edge, one foot forward of the fulcrum, and one foot aft of the fulcrum, and the feet at about a 3°–35° angle to the length and the width of the platform. Referring to FIGS. 1 and 2, the platform 17 may be modified to accommodate bindings, footwear or the like. As shown in FIG. 1, an array of openings 14 is provided in the forward and rearward longitudinal halves of the platform 17 (i.e., on each side of the fulcrum 19, 31 of the teeter-totter rocker arrangement 12 between the upper platform 17 and the lower board 16). As shown in FIG. 2, a binding 15 is provided atop each half-section of the rocker platform for retaining a foot.

When used as water ski, the user has one foot forward of the fulcrum, centered on the platform and toes pointing toward the tip of the board and the other foot centered on the platform after of the fulcrum and toes pointing toward the tip of the board.

As a wakeboard, the user is in the standing position; as a kneeboard, the user is in the kneeling position.

The present invention can be used to retrofit an existing sport board. Thus, and shown in FIG. 11 and in a second embodiment hereof, generally, denoted at 210 there is provided a mounting plate 212 to which is secured the rocker system hereof. The mounting plate 212 is dimensioned to lie atop or be superposed a sport board (not shown). The mounting plate is secured to the sport board through any suitable means, such as threaded fasteners, adhesives, and the like. In all respects the shock absorbing system is the same as in the first embodiment.

It is to be appreciated that there has been described herein a sports board which enables the user to ride on a "cushion of air" or other suitable fluid thereby softening the ride while at the same time providing a "teeter-totter" effect.

Figure 12:
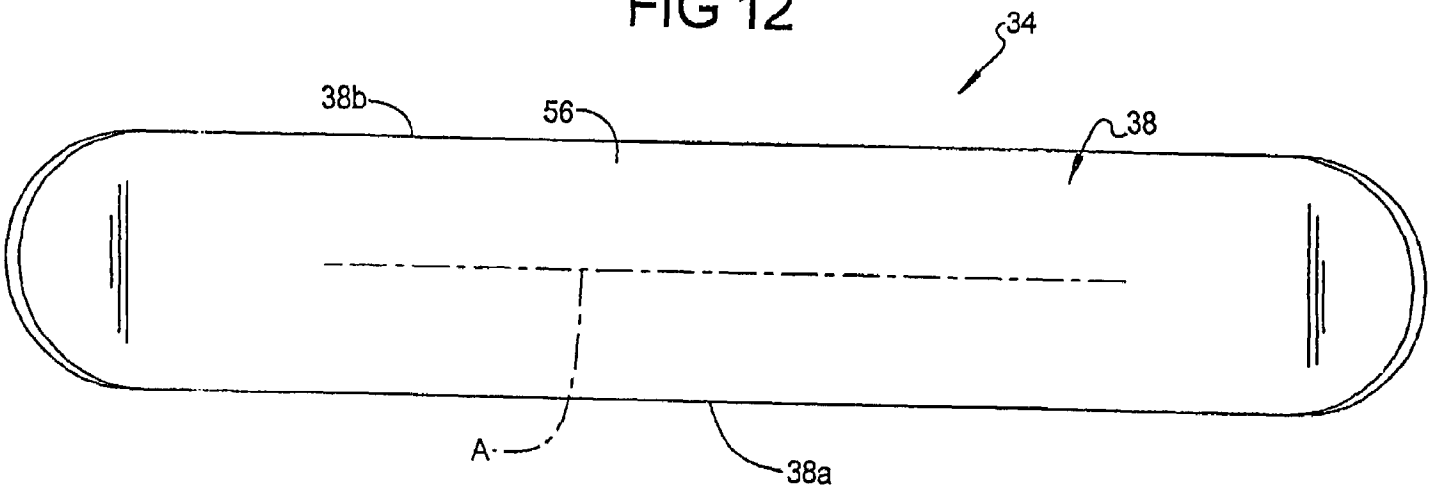
FIG. 12 is a top plan view of a skate board according to the present invention.
Figure 13:
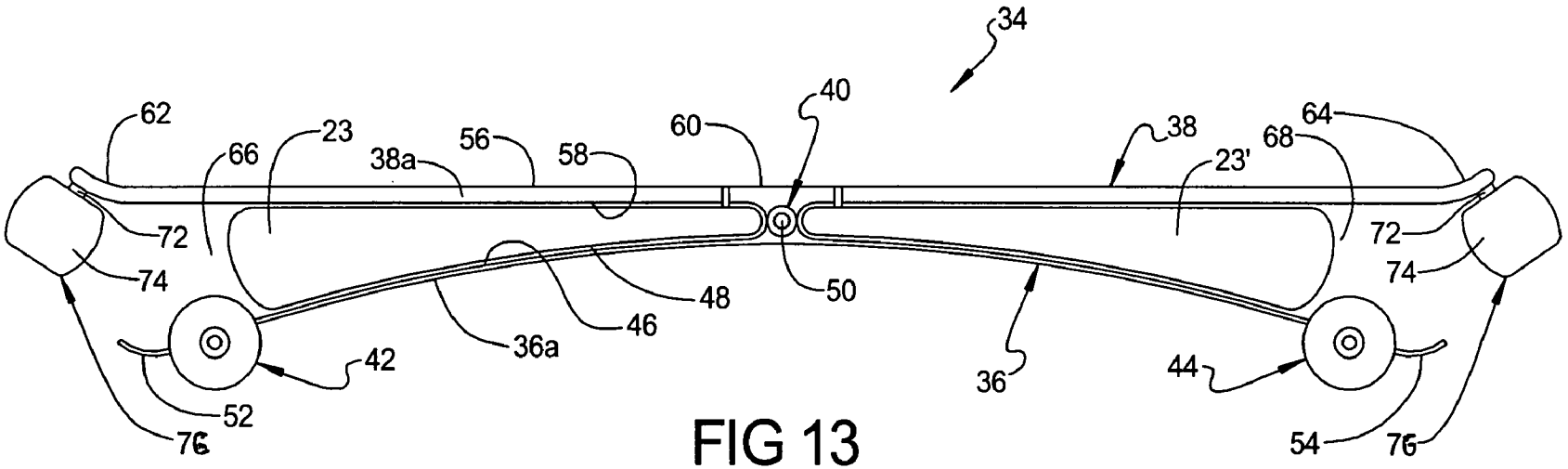
FIG. 13 is a side elevation view of the skate board of FIG. 12 having the rocker system hereof.

Turning to FIGS. 12–13, a second embodiment according to this invention comprises a rolling board 34 which is used in various ground-based sports. The board 34 is referred to as a "skate board" and is for illustrative purposes only.

The rolling or skate board 34 comprises a board or lower platform 36, an upper board or rocker platform 38, a hinge arrangement 40 for connecting the rocker platform 38 to the lower platform 36, and two pairs of rollers or wheels 42 and 44 connected to the lower platform 36. The lower platform or board 36 is generally oblong shaped, viewed in plan, symmetrically centered about a longitudinal axis "A", has parallel lateral sides 36*a* and 36*b*, a top surface 46, a bottom surface 48, and a compound curve shape. That is, the lower platform 36 is curvilinear from end to end and is concave down relative to the center or midsection 50 of the platform and concave up at the forward and rearward end sections 52 and 54. The compound curvature forms a resilient bow-like or spring structure between the roller assemblies 42 and 44 that absorbs and distributes vertical landing loads, strengthens the board, and gives the rider more control of the board.

The upper rocker platform 38 is generally planar and defines a "deck" upon which the rider stands in using the skateboard 34 herein. The rocker platform 38 is generally a "mirror image" of the lower platform 36 and is generally oblong shaped, viewed in plan, symmetrically centered about a longitudinal axis "A", has parallel lateral sides 38*a* and 38*b*, a top surface 56, a bottom surface 58, a center section 60, and concave up front and rear end sections 62 and 64.

The platforms may be comprised of wood, aluminum, fiberglass, plastic or carbon fiber, and made by pressing together various layers of these materials, depending on the desired degree of stiffness or flexibility desired. The actual materials and method of constructing the skate board to provide the desired combination of toughness, elasticity, feel and response are known in the art.

The hinge arrangement 40 connects the center sections 50 and 60 of the platforms 36 and 38 together such that the rocker platform 38 is atop the lower platform 38 and the forward and rearward end sections 62 and 64 of the rocker platform 38 move alternately up and down towards and away from the forward and rearward end sections 52 and 54 of the lower platform 36. That is, the upper rocker platform 38 is connected in a "seesaw" manner to the lower platform 36.

The hinge arrangement 40 forms a fulcrum, as described hereinabove, and includes the interdigitating hinge or rocker members 19 and 31 and the pivot pin 22 for interconnecting the hinge members together, the hinge member 19 being centrally connected to the lower platform 36 and projecting upwardly from the upper surface 46 thereof and the hinge member 31 being centrally connected to the upper rocker platform 38 and projecting downwardly from the bottom surface 56 thereof. The hinge arrangement 40 enables the upper rocker plate 38 to pivot and the opposite ends thereof to move up and down in a see-saw manner relative to the lower platform 36.

The wheels 42 and 44 are connected to the lower platform 36 adjacent to the front and rear end sections 52 and 54 by what are referred to as "trucks", or like known expedients known in the art, wherein to allow the board 34 to turn. The wheels 42 and 44 are preferably made of tough polyurethane plastic, having a durometer of about 85 (soft) and 97 (hard), and sized between 39 and 66 millimeters in diameter. The connection and wheel materials are conventional and will not be described further as known by those skilled in the art.

As shown in FIG. 13, when interconnected, the platforms 36 and 38 define a first channel or space 66 that extends between the fulcrum 40 and the forward end sections 52 and 62 and a second channel or space 68 that extends between the fulcrum 40 and the rearward end sections 54 and 64.

Preferably and according to this invention, the roller or skate board 34 is provided with an arrangement for absorbing shock arising from use. In a manner as described hereinabove, the compressible members 23 and 23', respectively, are disposed in the channels or spaces 66 and 68. The compressible members 23 and 23' are generally coextensive with and extend between the opposite lateral sides of the respective platforms 36 and 38 and extend between the pivot arrangement 40 and the concave forward and rearward end sections of the respective platforms 36 and 38.

As described hereinabove, the compressible member 23 and 23' may comprise a section of compressible foam, a section of elastomeric material, such as a rubber, or an inflatable bladder which may be toroidal or other convenient shape. In the case of the bladder, each bladder is independently inflatable with a suitable fluid such as water, or a suitable gas, such as air and the like. The pressure inside the bladders is set at a pressure (psig) desired by the rider, sufficient for the rider to exert extreme forces for balance, control, and maneuvers on any given terrain conditions.

To further absorb shock, a pair of bumpers 76 are mounted on the rocker platform 38, each bumper including a mounting pin 72 and a body 74 of elastomeric material, such as rubber. As shown in FIG. 13, one bumper is mounted to the curled concave up front end section 62 and the other bumper is mounted to the curled concave up rearward end section 64. Each bumper mounting pin 72 is generally centered on the longitudinal axis, perpendicular to its respective end section 62 and 64 and directed forwardly and downwardly towards the curled concave up forward and rearward ends sections 52 and 54 of the lower platform 36. The bumpers 76 are protective devices provided to absorb impact shocks or impede contact in a collision.

Although not shown in the drawing, it is possible to affix and emplace bumpers within the ring defined by the toroidal compressible members to limit the downward movement of the upper member in any of the boards hereof.

Furthermore, it is important to note that the sport boards defined herein are of the type where both of the user's feet are disposed thereon. Thus, each board accommodates a pair of feet, dual bindings, etc. What is critical to note is that, in use, both feet of the user are placed on the board. Also, the dual foot board hereof, when used, is stable and enables better banking and cutting.

Having, thus, described the invention what is claimed is:

1. A roller board, comprising:

a lower platform having a center section, a forward end section, and a rearward end section, a pair of roller assemblies secured to said lower platform for rollably supporting the platform on the ground, one roller assembly being secured to the forward end section and the other roller assembly being secured to the rearward end section, an upper rocker platform for supporting both feet of a user, said rocker platform having a center section, a forward end section, and a rearward end section, binding structure atop each said forward and rearward end section of said rocker platform for securing one and the other foot of the rider to the rocker platform, a hinge for hingedly connecting the center sections together and forming a teeter-totter arrangement wherein the forward and rearward end sections of the rocker platform alternately pivot towards and away from the respective forward and rearward end sections of the lower platform, and wherein a first and second space is defined, respectively, between the forward and rearward end sections of the rocker platform and on opposite sides of the hinge connection, and a first and a second compressible member disposed, respectively, in said first space and said second space, said compressible members resisting closing movement of the end sections towards one another.

2. The roller board as claimed in claim 1, wherein said platforms have a central longitudinal axis, parallel lateral sides extending longitudinally, and top and bottom surfaces, said hinge is disposed along a pivot axis generally transverse to said central longitudinal axis, and further wherein the forward and rearward end sections and lateral sides are generally in juxtaposed relation with one another when the center sections of the platforms are hingedly connected to one another.

3. The roller board as claimed in claim 2, wherein said rocker platform is generally flat and the front and rear end sections thereof are turned upwardly, said lower platform is in the shape of a compound curve, the curve defining a center section that is concave down and front and rear sections that are concave up, the concave down center section of said lower platform forming a resilient bow-like spring structure between the roller assemblies that absorbs and distributes vertical landing loads transmitted thereto by the user standing atop the upper rocker platform.

4. The roller board as claimed in claim 2, wherein said lower platform is formed from layers of material selected from the group consisting of wood, aluminum, fiberglass, plastic, and carbon fiber.

5. The roller board as claimed in claim 3, wherein said rollers are mounted at the respective transitions of the compound curve wherein said lower platform changes from a center section that is concave down and front and rear sections that are concave up and are made of polyurethane plastic, having a durometer measurement of between 85 and 97.

6. The roller board as claimed in claim 1, wherein the compressible member comprises an air bladder.

7. The roller board as claimed in claim 1, wherein, the compressible member comprises a body of compressible foam.

8. The roller board as claimed in claim 1, wherein the compressible member comprises a body of elastomeric material.

9. The roller board as claimed in claim 1, further comprising a first and a second bumper of elastomeric material, said bumpers being connected, respectively, to the forward and rearward end sections of said rocker platform wherein to project forwardly and downwardly and rearwardly and downwardly from the rocker platform and cushion impact forces.

10. The roller board of claim 1, wherein said hinge comprises an upper and lower hinge member, each hinge member including a pair of laterally spaced apertured flanges, and a hinge pin extending through each of the apertures to connect the hinge members together, the upper and lower hinge members being affixed, respectively, to the upper rocker platform and lower platform, and the apertures of at least one pair of apertured flanges being oblong shaped with substantially parallel sides arranged vertically disposed relative to the respective center sections of the platforms wherein the pin enables the rocker platform to vertically move up and down, pivot, and tilt relative to the hinge connection and compressible members to cushion the landing of the rider.

11. In a longitudinally elongated, one-piece, sports board including forward and rearward end sections and a center section centered along a longitudinal axis, a substantially flat upper surface, and a roller assembly proximate to each end section for rollably supporting the board on the ground, an improved shock absorber system to resist shock transmitted to the board by a rider standing thereatop and performing maneuvers, the improvement comprising:

a rocker platform, said rocker platform having a top surface, a center section for supporting the feet of the rider, a bottom surface, and concave up forward and rearward end sections, a hinge assembly for hingedly interconnecting the rocker platform atop the sports board, the interconnection defining a teeter totter arrangement and first and second spaces on the opposite sides of the hinge element that extend between the hinge element and the respective forward and rearward end sections of the rocker platform, the hinge assembly enabling the forward and rearward end sections of the rocker platform to alternately pivot up and down and towards and away from the upper surface of the sports board, and a pair of toroidal-shaped compressible members, one said compressible member being disposed in said first space and the other said compressible member being disposed in said second space.

12. The improvement of claim 11, wherein each said board and platform is oblong in shape, has a longitudinal axis, and parallel lateral sides extending longitudinally, the sides defining the width of the sport board and of said platform being substantially the same as one another, and said hinge assembly comprises a first hinge member affixed to the center section of said skate board, a second hinge member affixed to the center section of said rocker platform, and a pin for connecting the hinge members together and the rocker platform to the board, each said hinge member comprising a first and second laterally spaced apertured flanges, the aperture of each of said flange of said rocker platform being oblong and having a width formed by parallel sides disposed vertically and a vertical height greater than said width, the first flanges and the second flanges being juxtaposable with one another to align the apertures with one another and receive the pin, said pin and oblong apertures enabling the rocker platform to move up and down, teeter, and tilt relative to the board.

13. The improvement of claim 11, wherein each of the compressible members comprises an inflatable air bladder.

14. The improvement of claim 11, wherein each of the compressible members comprises a compressible foam.

15. The improvement of claim 11, wherein each of the compressible members comprises a compressible elastomeric material.

16. The improvement of claim 11, wherein:

the board is in the shape of a compound curve, the center section of said curve being concave down and the forward and rearward end sections being concave up, wherein to form a resilient bow-like spring structure between the roller assemblies that absorbs and distributes vertical landing loads.

17. The improvement of claim 16, further comprising a first and a second bumper of elastomeric material, said bumpers being connected, respectively, to the forward and rearward end section of said rocker platform wherein to project downwardly and forwardly and downwardly and rearwardly from the board and cushion impact forces.

18. A skate board, said skate board comprising:

(a) a lower platform, said platform being oblong in shape, longitudinally elongated and having a longitudinal axis, a pair of parallel lateral sides extending longitudinally, a top surface, a bottom surface, a concave down central section, and concave up forward and rearward end sections, (b) a forward and a rearward roller assembly, the roller assemblies for supporting the skate board for rolling movement on the ground and secured proximate to said forward and rearward end sections, (c) a longitudinally elongated rocker platform, said rocker platform being oblong in shape, having a longitudinal axis, a pair of parallel lateral sides extending longitudinally, a top surface, a bottom surface, a planar central section for supporting the feet of a rider, and concave up forward and rearward end sections, (d) rocker assembly, said rocker assembly connecting the center section of said rocker platform to atop the central section of said lower platform and defining a fulcrum in which the forward end sections may alternately move towards and away from one another as the rearward end sections move away and towards one another, a first space being defined between the forward end portions of the aforesaid platforms and a second space being defined between the rearward end portions of the aforesaid platforms, (e) a first and a second compressible member, the first compressible member being fixedly disposed in the first space and the second compressible member being fixedly disposed in the second space, the compressible members being engaged by and resisting movement of the respective end portions of the rocker platform towards the respective end portions of the lower platform, and (f) a first and a second bumper for absorbing and cushioning the skate board from shock arising from impact, the bumpers being fixedly mounted to and extending downwardly from and longitudinally forward and rearward away from the forward and rearward end sections of the rocker platform, each bumper comprised of an elastomeric material.

19. The skate board of claim 18, wherein the compressible members are each toroidal air bladders.

20. The skate board of claim 19 which further comprises:

a third and fourth bumper for cushioning the board and limiting downward movement of the forward and rearward end sections of the platform towards the corresponding forward and rearward end sections of the board, and each said toroidal bladder including a central opening for receiving a respective of said third and fourth bumpers, the third and fourth bumpers being disposed in a respective of said first and second spaces and within the central openings of the toroidal air bladders.

* * * * *